US005680797A

United States Patent [19]

Elsässer

[11] Patent Number: 5,680,797

[45] Date of Patent: Oct. 28, 1997

[54] MANUAL CONTROL APPLIANCE WITH A CONTROL LEVER

[75] Inventor: Fabian Elsässer, Straubenhardt, Germany

[73] Assignee: NBB Machrichtentechnik GmbH & Co. KG, Olbronn-Durnn, Germany

[21] Appl. No.: 495,441

[22] PCT Filed: Feb. 17, 1994

[86] PCT No.: PCT/DE94/00196

§ 371 Date: Dec. 14, 1995

§ 102(e) Date: Dec. 14, 1995

[87] PCT Pub. No.: WO94/20894

PCT Pub. Date: Sep. 15, 1994

[30] Foreign Application Priority Data

Mar. 3, 1993 [DE] Germany ..... 43 06 577.5

[51] Int. Cl.[6] ..... G05G 5/06

[52] U.S. Cl. ..... 74/528; 74/527; 74/475; 74/471 R; 74/543; 74/557

[58] Field of Search ..... 74/527, 528, 531, 74/475, 477, 519, 489, 502.2, 513, 548

[56] References Cited

U.S. PATENT DOCUMENTS

| | | | |
|---|---|---|---|
| 3,602,245 | 8/1971 | Meisel | 74/527 X |
| 4,121,065 | 10/1978 | Woodard | 74/528 X |
| 4,573,365 | 3/1986 | Kennard et al. | 74/527 X |
| 4,768,395 | 9/1988 | Tagawa | 74/489 |
| 5,038,632 | 8/1991 | Watson | 74/475 |
| 5,205,538 | 4/1993 | Mackoway et al. | 74/531 X |
| 5,214,980 | 6/1993 | Saeda et al. | 74/527 |

FOREIGN PATENT DOCUMENTS

| | | |
|---|---|---|
| 0 459 183 A1 | 12/1991 | European Pat. Off. . |
| 0 501 906 A1 | 9/1992 | European Pat. Off. . |
| 654375 | 12/1937 | Germany . |
| 1217481 | 5/1966 | Germany . |
| 1350073 | 4/1974 | United Kingdom . |

*Primary Examiner*—Vinh T. Luong
*Attorney, Agent, or Firm*—Loeb & Loeb LLP

[57] ABSTRACT

A manual control appliance with includes a control lever mounted in a bearing for pivotal movement about a fixed point, converter devices coupled to the lever for converting deflections of the lever with respect to two orthogonal axes into electrical output signals proportional to the deflection of the lever with respect to each of the axes, and a preshaped part having a surface in the form of a spherical section and provided with a plurality of detent grooves which cooperate with a slider at a lower end of the lever. The slider cooperates with the detent grooves in such a manner as to transmit to a user a tactily perceivable sensation each time said lower tip moves across a detent groove in order to provide tactile information about stepped portions of said control lever without affecting operation of said converter means and without limiting pivotal movement of said control lever.

5 Claims, 4 Drawing Sheets

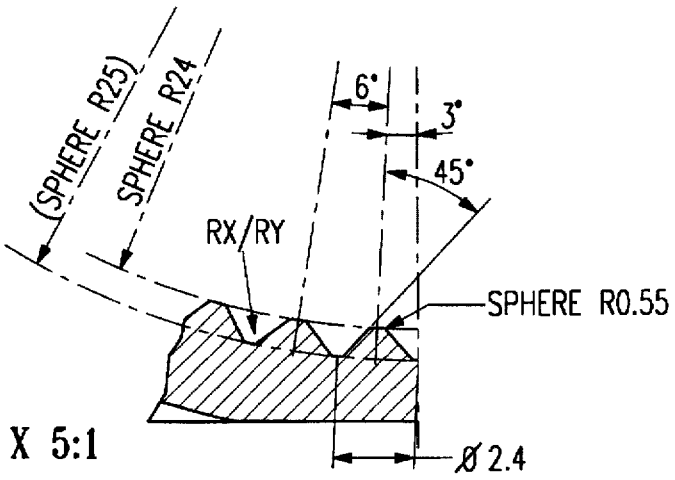
FIG. 5
FIG. 6
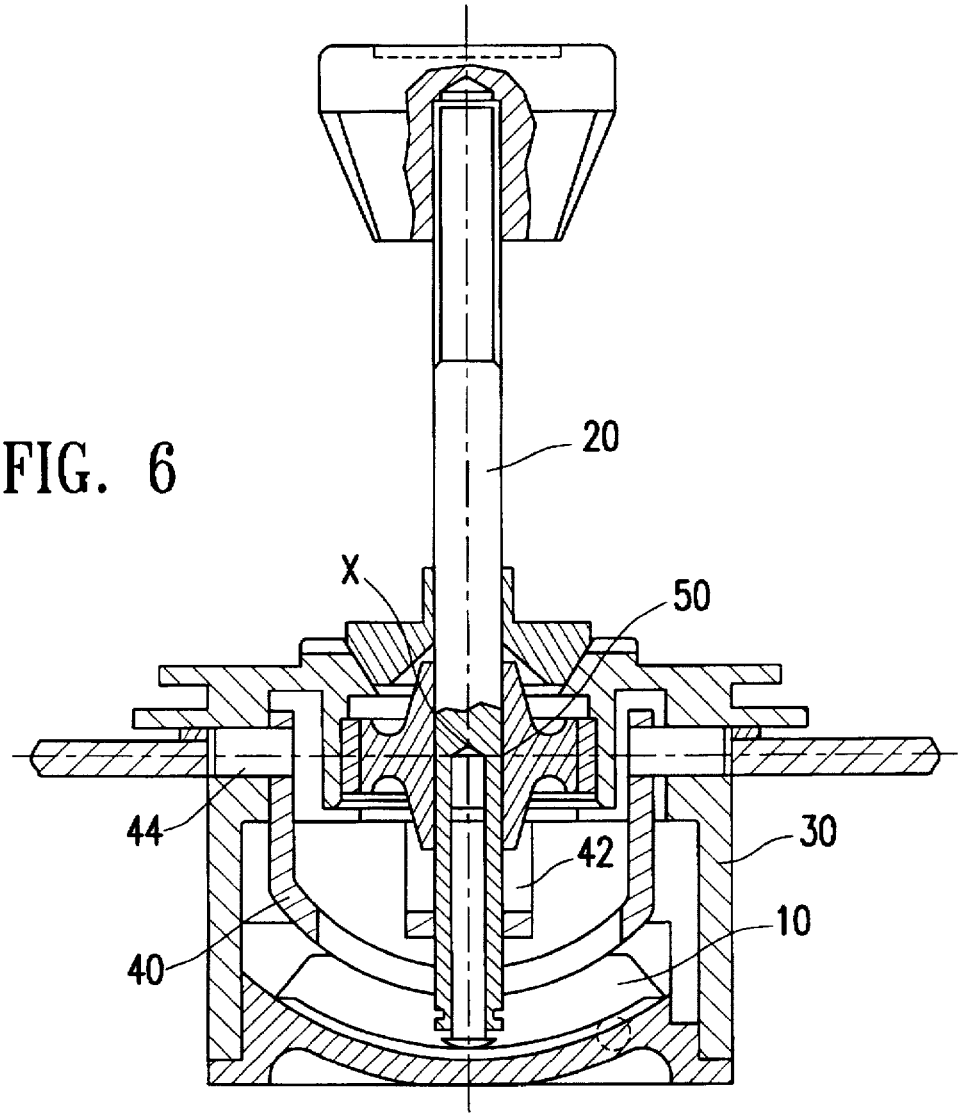

MANUAL CONTROL APPLIANCE WITH A CONTROL LEVER

TECHNICAL FIELD OF THE INVENTION

The invention relates to a manual control appliance in accordance with the preamble of claim 1.

Such manual control appliances are a control device known from many fields of use; they should be best known for operating computers (in this case called "joystick"), however, they are also employed for controlling and steering, in particular for the remote control of real devices, for example, cranes, hoists, etc.

The manual control device has a control lever as the sole actuating element, which is movable in two independent directions and whose movement in each direction (x or y) acts on a transmission element. Therefore two transmission elements are components of converters which convert the deflection of the control lever into an electrical signal; in this connection the manual control appliance can be used as an on/off switch as well as a proportional control element, wherein the electrical output signals in both main directions are proportional to the respective deflection of the control lever in the associated main direction.

To achieve such pivoting of the control lever, it is necessary that it be pivotably seated and held in a housing; on the one hand, sufficient deflection (deflection angle) must be assured, and on the other hand as precise as possible a definition provides the user with additional information regarding the respective control position of the control element. With manual control appliances in particular which are used for the remote control of cranes or the like, for example, such additional information which is transmitted via a feeling in the hand is of particular importance, since as a rule the view of the user must remain on the remote-controlled device for safety reasons and thus visual displays on the manual control appliance, for example, would divert the attention of the user.

STATE OF THE ART

Numerous detent devices are known in many structural variations wherein as a rule an interchanging effect with the lower end of the control lever exists in such a way that the tip of the control lever encounters different resistances during its deflection movement, which is then passed on to the user by corresponding control information.

Separate components are mostly provided for the detent devices, which are more or less elaborately constructed and must be fitted separately into the housing of the manual control appliance, in which case there is a considerable amount of adjusting work to be performed; as a whole such detent devices also represent a cost factor in connection with manual control appliances which should be as low as possible.

In connection with multiple switches which can be selected with the aid of a control lever (DE,C, 654 375; DE,B 12 17 481) it is known to provide guide grooves and detents (DE,C, 12 17 481) or depressions I, II, III, IV (DE,C, 654 375) in a dome-like embodied bottom of the housing to define the movement of the control lever which are arranged in such a way that a detent position of the control lever used as selective switch is assigned to each of the several contacts. Therefore each detent position of the control lever has a direct connection with the making of a defined contact. The shape of the spherical-shell-like housing bottom or of the housing dome is therefore used for a more exact definition and error-free contacting of such multiple switches.

OBJECTS OF THE INVENTION

It is an object of the invention to embody the pivot bearing of a manual control appliance in such a way that it can be produced with the most simple means, is simple to install into the manual control appliance and is dependable in its function.

In accordance with the invention this object is attained in accordance with the characterizing portion of claim 1.

The basic concept of the invention therefore consists in that only a single preformed part is provided and that the detent positions and the desired stepped deflection characteristics are simply achieved in that the spherical-section-shaped surface of appliance, in which case there is a considerable amount of adjusting work to be performed; as a whole such detent devices also represent a cost factor in connection with manual control appliances which should be as low as possible.

Control levers or control transmitters of the type mentioned are known, for example, from EP 0 459 183 A1 and EP 0 501 906 A1.

OBJECT OF THE INVENTION

It is an object of the invention to embody the pivot bearing of a manual control appliance in such a way that it can be produced with the most simple means, is simple to install into the manual control appliance and is dependable in its function.

In accordance with the invention this object is attained in accordance with the characterizing portion of claim 1.

The basic concept of the invention therefore consists in that only a single preformed part is provided and that the detent positions and the desired stepped deflection characteristics are simply achieved in that the spherical-section-shaped surface of the preshaped part is covered net-like with detent grooves.

In this case the exterior cross section is practically adapted to the interior cross section of the housing of the manual control appliance so that in accordance with an advantageous embodiment such a one-piece preshaped detent device part can constitute the bottom of the housing at the same time, in other words, no separate components at all are required for the detent device as such and instead with this embodiment the detent effect is achieved by a specific design of the bottom part of the housing of the manual control appliance.

If in addition the preshaped part has a circumferential rim on its lower edge, it is achieved that the shaped part is fixed in place in the direction of the longitudinal axis of the housing, since such a circumferential rim then acts as a detent shoulder on which the wall of the housing is seated. With an exterior cross section of the preshaped part adapted to the interior cross section of the housing on the one hand and with the mentioned rim shoulder on the other, an exact positioning of the preshaped part in the manual control appliance is therefore achieved, no additional adjusting steps are necessary, the surface of the preshaped part provided with the detent grooves then is necessarily in exactly the position which has been predetermined and defined for the cooperation with the control lever.

The number of detent grooves in the two main directions (x and y) then corresponds to the preselected switching steps, wherein the shaping of the cross section of the detent grooves in cooperation with the design of the lower end of the control lever determines the "switching characteristics" in the sense of a more or less hard or soft step characteristic during the deflection of the control rod.

Further embodiments of the invention can be taken from further dependent claims.

BRIEF DESCRIPTION OF THE DRAWINGS

An exemplary embodiment of the detent device in accordance with the invention will now be described in detail by means of the drawings. Shown are in:

FIG. 5, a sectional view of the detail X in FIG. 4 and

FIG. 6, a schematic section through a manual control appliance with the preshaped part installed.

DESCRIPTION

Figure 2:
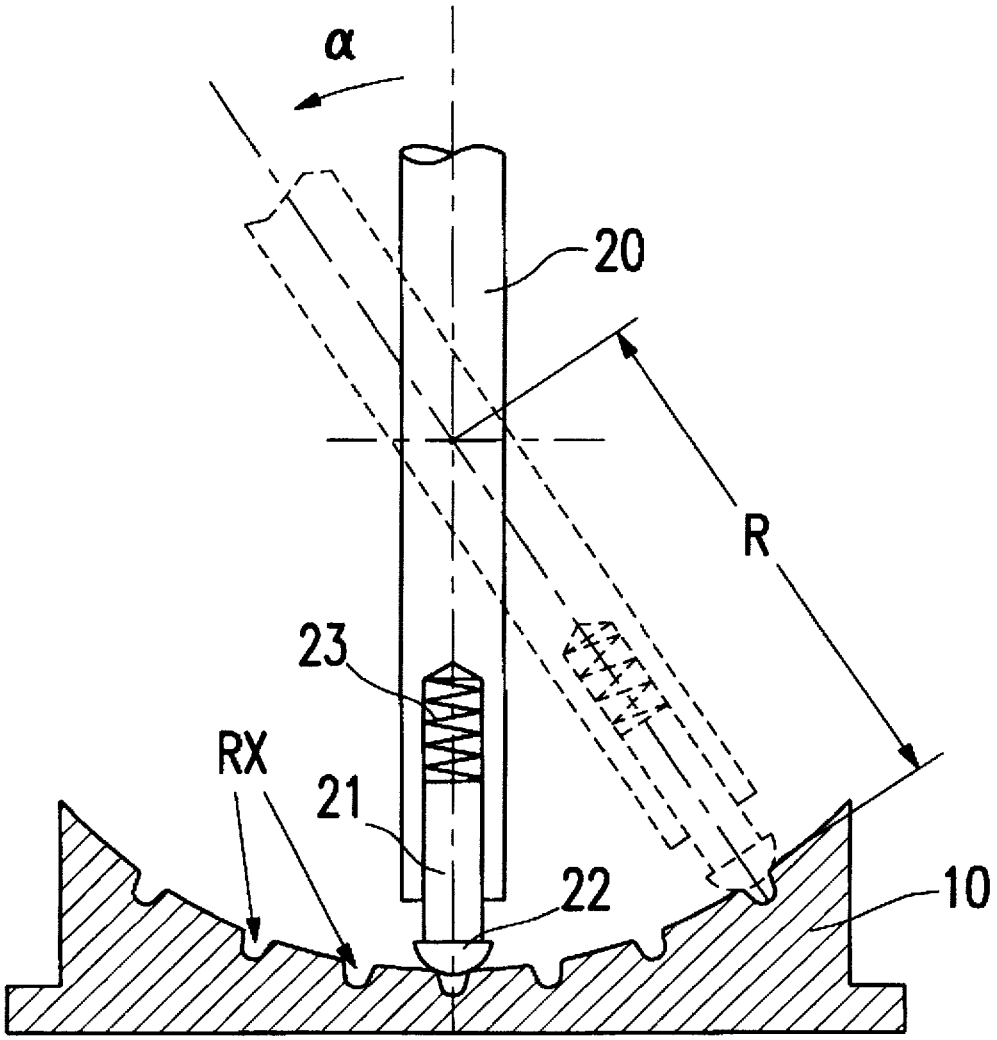

The preshaped part 10 essentially consists of a plate-shaped part, whose cross section is adapted to the interior cross section of the housing 30 of the manual control appliance in such a way that it constitutes the bottom of the housing 30, whose walls are then seated on a circumferential rim 11. The upper surface, i.e. facing the interior chamber of the housing 30, of this preshaped part 10 is embodied to be in the form of a section of a sphere, wherein the radius of the associated sphere essentially corresponds to the radius of the surface of the sphere on which the end of the control lever 20 moves in the course of the deflection movement (radius R in FIG. 2).

Such a preshaped part 10 can be made of plastic, for example (for example injection molded), however, it can also be made of ceramic materials or metal.

Figure 1:
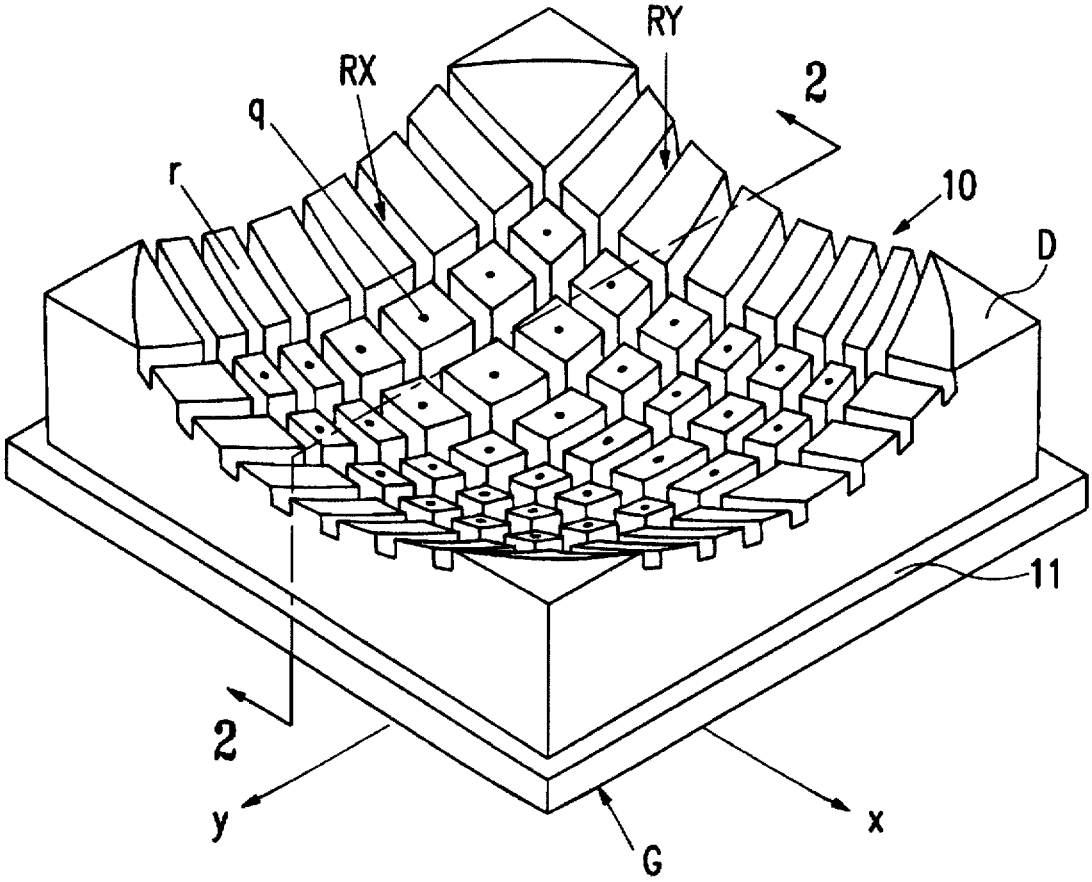
FIG. 1, a perspective total view of a preshaped part constituting a part of the detent device, FIG. 2, a schematic function representation of the preshaped part (section 2—2 of FIG. 1) in cooperation with the control lever, FIG. 3, a top view of the preformed part in FIG. 1 with dimension examples, FIG. 4, a cross section through the preformed part in the vertical plane A—A or B—B of FIG. 3

The spherical-section-shaped surface is covered by a net or grid of detent grooves RX, RY, which extend in the two main directions x and y of the control lever 20. Square partial surfaces q are created in the central part of this surface by these detent grooves RX, RY, which are identified in FIG. 1 by a dot on their surface. This central square area is enclosed by a circumferential edge area in which the detent grooves RX, RY divide the surface into rectangular partial areas r, whose longitudinal axes point toward the center of the preshaped part 10.

In the corners of the edge area, the spherical-section shape of the surface makes a transition into essentially triangular end surfaces D extending parallel with the base G of the preshaped part and which form, for example, the "remainder" of the originally flat surface of the preshaped part 10 prior to forming the spherical-section-shaped surface.

This preshaped part 10 constituting the bottom of the housing 30 is therefore a part of the detent device.

The other part of the detent device is located in the control lever 20 and consists of a slide 21, seated in the control lever 20 and spring-loaded, whose lower end 22 cooperates with the detent grooves RX, RY wherein because of the spring 23, in the area of each detent groove the slide enters into the groove more or less deeply, depending on its shape and the shape of the lower end 22 and in this way creates a more or less distinctive "detent feeling" in the course of operating the manual control appliance.

In the exemplary embodiment shown, the cross sections of the detent grooves are essentially V-shaped (FIG. 5), wherein the transition areas are rounded to avoid too harsh a detent characteristic.

Figure 3:
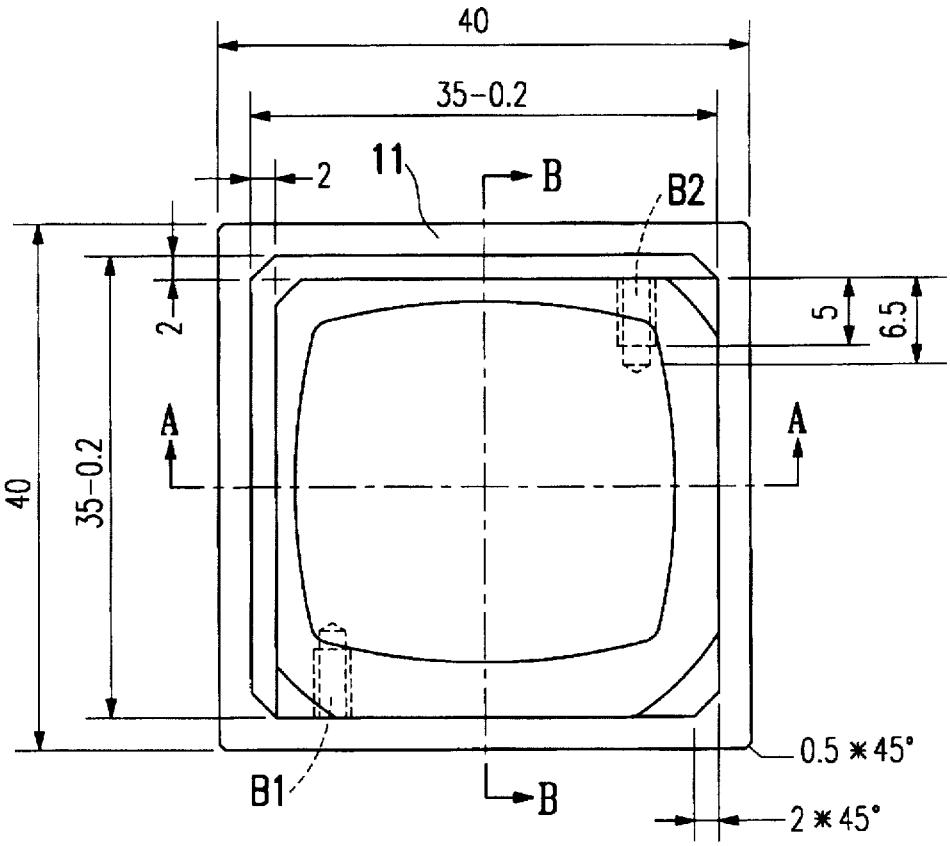
Figure 4:
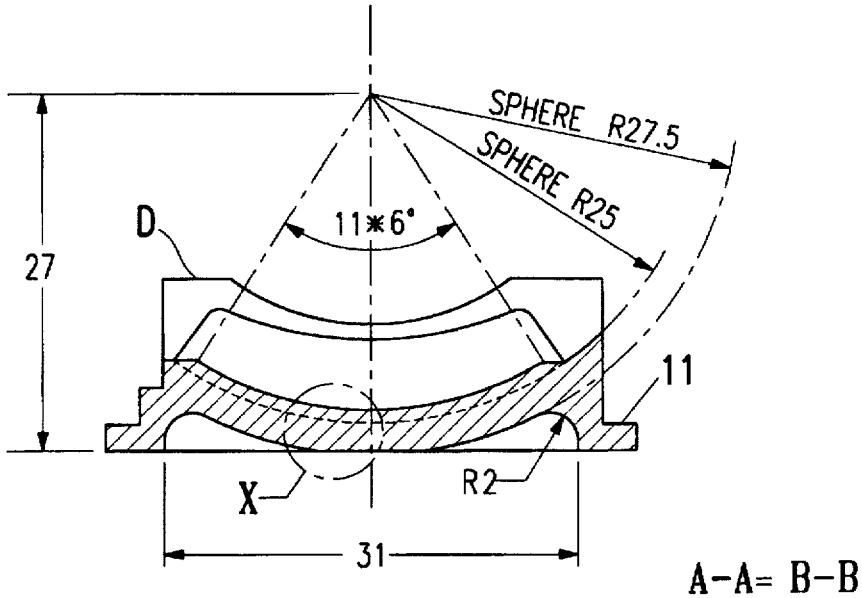

The preshaped part 10 can be inserted from below into the housing 30 without any difficulties and fixed in place there by means of two diagonally opposed bolt connections B1, B2 (FIGS. 3 and 6).

FIG. 6 also shows the basic components of a converter device that may be employed, by way of example, in a manual control appliance according to the present invention. This converter device is composed of two brackets 40 and 42 each mounted for pivotal movement together with control lever 20 about fixed point (X). Each bracket 40, 42 is mounted in appropriate pivot bearings and is connected to a proportional converter, such as a potentiometer 44 associated with bracket 40. An identical potentiometer (not visible) is associated with bracket 42. Each potentiometer may be connected in a conventional manner to provide an output voltage proportional to the angular deflection of lever 20 about pivot point (X) from its neutral position, the neutral position being that in which control lever 20 has a vertical orientation in FIG. 6. Lever 20 is mounted for pivotal movement in a bearing 50.

I claim:

1. A manual control appliance comprising:

a control lever (20) having a lower end;

a housing (30) having a bottom;

a bearing (50) held in said housing and supporting said control lever for pivotal movement with respect to two orthogonal axes about a fixed point (X);

converter means (40, 42, 44) coupled to said control lever for converting deflections of said control lever with respect to the two orthogonal axes into an electrical output signal proportional to the deflection of said control lever with respect to each orthogonal axis;

a preshaped part (10) having a surface with a shape of a spherical section, said surface being formed to have a plurality of detent grooves (RX, RY), said detent grooves being formed in said surface to form a grid; and a slider seated in said lower end of said control lever, said slider comprising a lower tip and a spring urging said lower tip toward said preshaped part to cause said lower tip to engage said surface of said preshaped part and said detent grooves, wherein said detent grooves divide the surface of said preshaped part into individual partial surfaces, said plurality of detent grooves are divided into a first group of detent grooves extending in a first direction and a second group of detent grooves extending in a second direction perpendicular to the first direction, and said lower tip and said detent grooves are shaped, and said spring has spring characteristics, matched to one another for causing said control lever to transmit to a user a tactily perceivable sensation each time said lower tip moves across a detent groove in order to provide tactile information about stepped positions of said control lever without affecting operation of said converter means and without limiting pivotal movement of said control lever.

2. A manual control appliance in accordance with claim 1, wherein the detent grooves (RX, RY) have an essentially V-shaped or semicircular cross section.

3. A manual control appliance in accordance with claim 1, wherein the tip (22) of the slide (21) is essentially shaped as a section of a sphere.

4. A manual control appliance in accordance with claim 1, wherein said surface of said preshaped part is composed of a rectangular central area and a circumferential edge area surrounding said central area, said individual partial surfaces are located in said central area and are rectangular and have longitudinal axes that intersect the center of curvature of said surface of said preshaped part.

5. A manual control appliance in accordance with claim 4, wherein said preshaped part has a flat base and said circumferential edge area has corners at which said surface having the shape of a spherical section undergoes a transition to triangular corner surfaces which extend parallel to said flat base.

* * * * *